United States Patent [19]

Perineau et al.

[11] 4,373,703

[45] Feb. 15, 1983

[54] DEVICE FOR RAPIDLY COOLING METAL TUBES

[75] Inventors: Philippe Perineau, Aubervilliers; Yves Lebreton, Aulnoye, both of France

[73] Assignee: Vallourec, Paris, France

[21] Appl. No.: 349,050

[22] Filed: Feb. 16, 1982

[30] Foreign Application Priority Data

Feb. 27, 1981 [FR] France ..... 81 04380

[51] Int. Cl.[3] ..... C21D 1/62

[52] U.S. Cl. ..... 266/131; 148/143; 266/133

[58] Field of Search ..... 266/130, 131, 133, 259, 266/117; 148/143, 148, 153; 134/147

[56] References Cited

U.S. PATENT DOCUMENTS 1,713,136 5/1929 Leck ..... 266/117

3,212,766 10/1965 Heinenberg ..... 266/133

3,623,716 11/1971 Fritsch ..... 148/143

*Primary Examiner*—L. Dewayne Rutledge

*Assistant Examiner*—Scott Kastler

*Attorney, Agent, or Firm*—McDougall, Hersh & Scott

[57] ABSTRACT

The device according to the present invention is an improvement on the conventional devices for quenching metal tubes (3) by immersion into a tank (4) of liquid at ambient temperature.

This device comprises in particular a deflector (18) positioned below the tube at the time of its immersion. This deflector distributes the contact of the cooling fluid on the surface of the tube (3). It allows a more homogeneous cooling and avoids asymmetric deformations of the tube (3). An air injection system fastened to the end of the tube to be treated is associated with this deflector.

This device will be particularly useful in installations for treating very long, thin tubes.

16 Claims, 10 Drawing Figures

DEVICE FOR RAPIDLY COOLING METAL TUBES

This invention relates to a device for cooling hot metal tubes by immersion, devices which are capable, for example, of intervening in the tube production cycle either immediately after the tube has been shaped while hot, or intervening for a specific thermal treatment, for example, a quenching treatment.

The production of metal tubes and in particular steel tubes generally necessitates shaping, thermal treatment and finishing operations.

It is conventional to have to carry out quenching or hyperquenching operations necessitating rapid cooling from an elevated temperature.

Different techniques have been developed hitherto for quenching tubes.

A first group of techniques comprises the pass treatment. In this process, the hot tube is cooled by a liquid distributed by a sprinkling ring around the tube. In order to avoid longitudinal deformations of the tube, this method very often necessitates the tube being moved on with a helical movement and necessitates the ends of the tube being closed to prevent any inopportune entry of water. In order to obtain a homogeneity of treatment in the longitudinal direction, this method often even necessitates proceeding with the cooling operation at the outlet of a reheating furnace which maintains the adequate temperature substantially constant in the rear part of the tube during its forwards movement.

In the particular case of long, thin steel tubes produced by the glass extrusion process which exit from the extrusion press at from 1100° to 1200° C., a very short time of the order of about 20 seconds is available for carrying out the operation. The movement speed in the quenching installation which, for such tubes, would be of the order of 30 m/min, does not allow a correct thermal treatment to be carried out on the pass for tubes which are 15 m long, a conventional length in the glass extrusion process, and it is necessary to have recourse to a treatment which is carried out subsequently in order to obtain good quality tubes.

Moreover, above a certain thickness of products to be treated, it is necessary to cool the inside of the tube using an appropriate device in order to obtain a sufficiently high cooling rate at all points of the section of the tube.

The pass technique requires installations which are dimensionally large and mechanically complex, the use of which is restrictive.

The second group of techniques comprises the immersion treatment. In this case, the method comprises completely and rapidly immersing into a cooling tank which is filled with a cooling liquid, the hot tube which has issued from the hot shaping tool or from the hot treatment furnace.

This method has the advantage of being simple and rapid, but it has the major disadvantage of subjecting the tube to irregular cooling conditions, as much over the length as over the cross section, in particular in view of the very irregular penetration of the cooling fluid inside the tube. Consequently, if the treated products are thin tubes or if they have a high ratio of external diameter to thickness, for example greater than 20, considerable longitudinal deformations, in the form of so-called "shirt sleeves" are produced which render impossible or considerably inconvenience the subsequent operation of the tube and this is an inconvenience which, in spite of the straightening operations, may be refound in the quality of the finished products.

Different proposals have been made hitherto to improve the immersion quenching technique. Thus, attempts have been made to regulate the cooling rate by producing a considerable stirring agitation of the cooling bath or by immersing the tube inclined into the cooling liquid to assist a more regular introduction of the cooling liquid inside the tube.

In fact, none of these techniques has resolved the fundamental problem, because the introduction of water inside the tube, halfway along, is effected randomly and it is impossible to control the straightness of the tube after cooling. This problem is particularly sensitive halfway along the tube. Finally, during the immersion of a tube which is presented horizontally, the lower generatrix of the tube comes into contact with the cold liquid before the upper part.

The object of the present invention is to provide a device for rapidly cooling by immersion very long, hot, metal tubes. This method does not have the disadvantages which have been described above and it provides a regular cooling. After being treated according to the present invention, the tubes do not have a notable straightness anomaly necessitating a specific treatment before production is continued.

The cooling device which is an object of this invention comprises means for transferring the hot tubes upstream, a quenching tank containing the cooling liquid, means for transferring the hot tubes onto the immersion device, an immersion device, means for clamping the tube and means for recovering, removing and transferring the tubes downstream. The device comprises a longitudinal deflector in the general shape of a channel or an angle iron, positioned straight below and at a slight distance from the tube without being in contact therewith. This deflector precedes the tube in the manner of a bow at the time of its first contact with the cooling liquid, then, during its descent into the tank containing the liquid. Just as the lower generatrix of the tube reaches the level of the liquid during the descent of the tube, the deflector has spread apart and projected the liquid to both sides. Thus, the first contact between the tube and the liquid is slightly delayed. Moreover, instead of this first contact being made by the lower generatrix of the tube, it is effected symmetrically along two lateral generatrices which are next to those corresponding to the tube cross section through a horizontal, diametral plane. During its descent into the tank ahead of the tube, the deflector produces eddies and a symmetrical circulation of liquid around the tube.

The cooling device also comprises an air injection system of considerable flow rate which is fastened to one end of the tube to be treated. This system blows compressed air into the tube during its descent into the tank and while it is kept immersed.

In parallel, a plurality of small tubes for circulating and agitating the cooling liquid is distributed longitudinally in the tank, the liquid of which is maintained at a homogeneous temperature approaching ambient temperature before immersion.

Before immersion, the tube is positioned longitudinally on the immersion device, on the side of air injection and is held fast in this position by a shoe in order to allow the fastening of the air introduction system.

The operation of the cooling device will now be explained.

A hot tube to be quenched or hyperquenched, of which at least one end is terminated by a clean cut substantially perpendicular to the axis of the tube is transported by a horizontal conveyor which is parallel to the axis of the tank. The tube is positioned with respect to the tank by a retractable stop positioned at the front or rear end of the tube. The tube is then taken over by a lateral transfer system composed, for example, of inclinable arms keyed on a common shaft which passes the tube from the conveyor position to the immersion system position. The immersion device receives the tube which is immediately immobilized longitudinally in this position by a clamping system supported by the immersion device, controlled by a pneumatic jack positioned in the vicinity of the end having served in positioning the end which is terminated by a clean cut. The air injection system composed of an air nozzle is applied to the end of the tube from the side where it was immobilized. The tube is then abruptly immersed into the cooling liquid by the descent of the immersion device, and is then kept immersed for the time necessary to obtain the required cooling.

In the descent phase of the tube, the deflector produces a depression in contact with the cooling liquid and this depression means that the lower generatrix of the tube descends to a level lower than that of the cooling liquid in the tank, before coming into contact with the liquid. Immediately afterwards, the cooling liquid passes above the blades of the deflector and simultaneously comes into contact with the tube along two lateral generatrices which are next to the diametrically opposite generatrices. Thus, a symmetrical cooling is provided from the first contact with the liquid.

Simultaneously, but before commencement of the descending movement, an air nozzle which is supported by a plate joining with and butted on the tube is introduced into the end of the tube which has a clean cut and which has previously been clamped. Air is injected at a fast flow rate through this nozzle in continuous manner during the entire treatment. During the descent and while maintaining immersed, the nozzle with its plate remains immobilized at the end of the tube by a mechanical follower device associated with the tank. In this manner, the permanence of air circulation is ensured in the tube during the entire treatment, while preventing the tube from moving away from the compressed air injection device due to the clamping device, whether this is under the pressure produced by the air or whether by the contraction due to the cooling. The water which may penetrate inside the tube through the empty spaces between the plate and the tube is sprayed and driven at high speed by the air current. This contributes to homogenizing the temperature inside the tube while contributing to the cooling thereof.

The essential objective of the deflector is to render symmetrical the circulation currents of the cooling liquid during the descent phase. Thus, it is important that without being in contact with the tube, the deflector is positioned at immediate lower right angles with the tube. It may be produced in many forms, for example it may be in the form of a more or less open V-shaped angle iron or, for example, in the form of a semicircular, rounded channel or cradle. In order to fulfill its function, the deflector must be adapted to the dimensions of the tubes to be treated. Among other methods, this may be achieved by adjusting the width of its blades or, if it is in the form of an angle iron, by opening its bending angle or, finally, by adjusting the vertical distance which separates it from the tube. The deflector extends in a substantially continuous manner over the complete length of the immersion device, but it may be produced such that it leaves a passage for the arm bringing and removing the tubes.

The objective of the device for injecting air into the tube is to prevent a random introduction of the cooling liquid into the tube. The flow rate and the speed of the air in the tube should be sufficient to ensure a considerable forced circulation. The cross section of the nozzle as well as the air pressure at this level should be sufficient to ensure this circulation. The cross section of the air nozzle should be adapted to the internal cross section of the tube to be quenched. Satisfactory operational conditions are obtained with the compressed air of the system, that is of the order of 5 effective bars while using a ratio of internal cross section of the tube to be cooled to the cross section of the nozzle of about 3.

The injectors for circulating and agitating the cooling liquid which are distributed longitudinally in the tank operate during the complete cooling procedure, starting from the beginning of the descent phase. This action homogenizes the temperature of the cooling liquid of the tank and assists the reduction of the calories of the tube by the cooling liquid. Moreover, the liquid in the tank is recirculated at a constant level and its average temperature is maintained by an external cooling system at the quenching tank, properly speaking, at a value approaching the ambient temperature.

At the end of cooling in the tank, the tube is raised out of the cooling liquid. The air injection is then stopped, the air nozzle is disconnected and the tube is released from its clamps. It is then taken by a removal device which raises and laterally transfers the tube to move on to the subsequently stages of production. In general, a conveyor parallel to the axis of the tank ensures this operation. The removal device may comprise, for example, inclinable arms and a momentary stopping position may be provided to allow the tube to drip above the tank.

The device which is an object of the present invention may be designed so that the upstream and downstream conveying systems are distinct or merged. When they are merged, the tubes are guided from the same side with respect to the tank and by the same means as the transfer of the tube to the following production stations. Likewise, the lateral transfer system of the tube from the conveyor to the immersion system, the immersion system and the system for recovering the tubes for lateral transfer after quenching may be distinct or common in entirety or in part, a single device then ensuring the two or three functions without exceeding the scope of the present invention.

All the lateral transfer devices which are operated within the scope of the present invention are of a known and conventional design.

The cooling device which is an object of the present invention may be used as a quenching system, either at the outlet of a heating furnace, or at the outlet of a tool for shaping the tube when hot, as for example, a glass extrusion press. The device is particularly well adapted to the treatment of thin tubes, the ratio of which between the external diameter and thickness is considerable, generally greater than 20, and with a considerable length, that is of the order of from 10 to 20 m.

In order to provide a better understanding of the present invention and of the characteristics thereof, one embodiment will now be described by way of nonrestricting example, while referring to the accompanying drawings.

Figure 1:
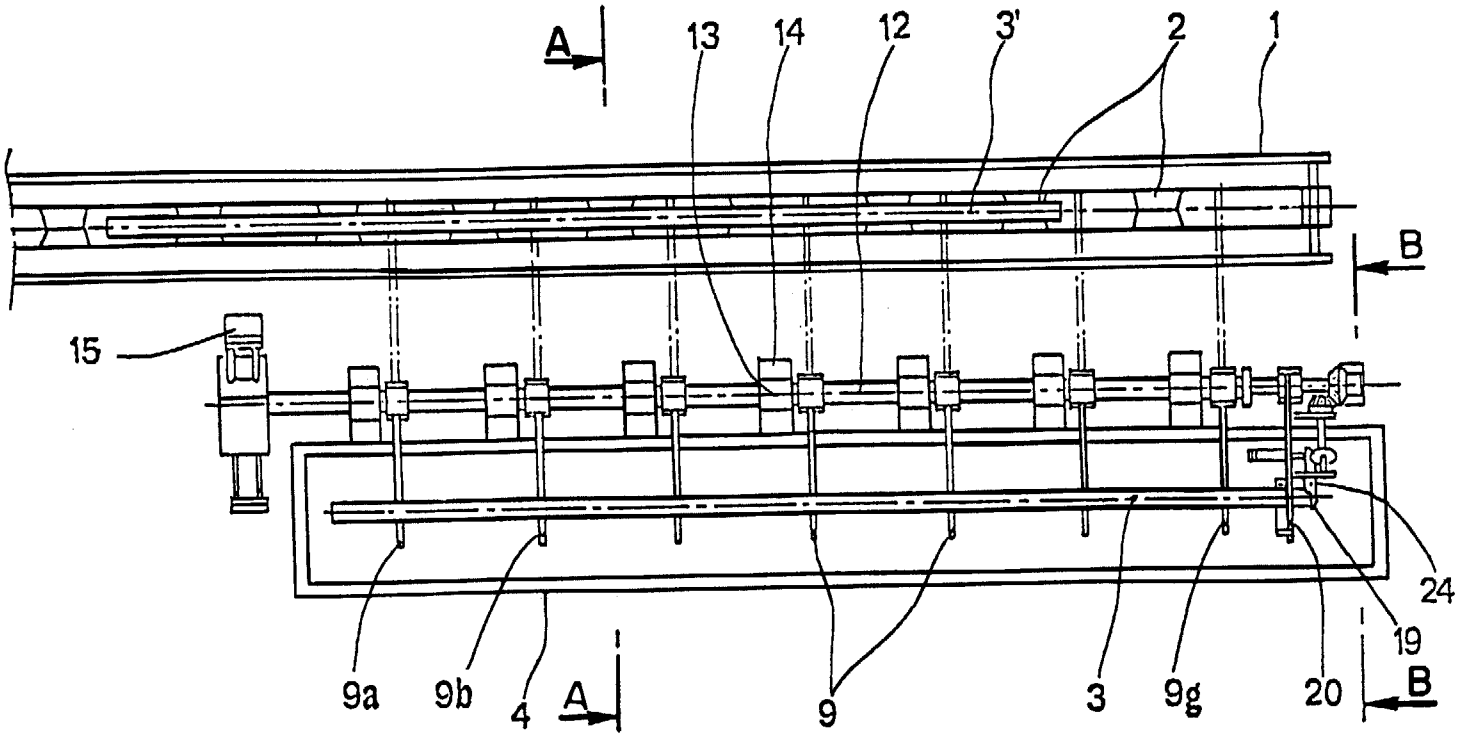
FIG. 1 illustrates a top view of the complete cooling device.
Figure 3:
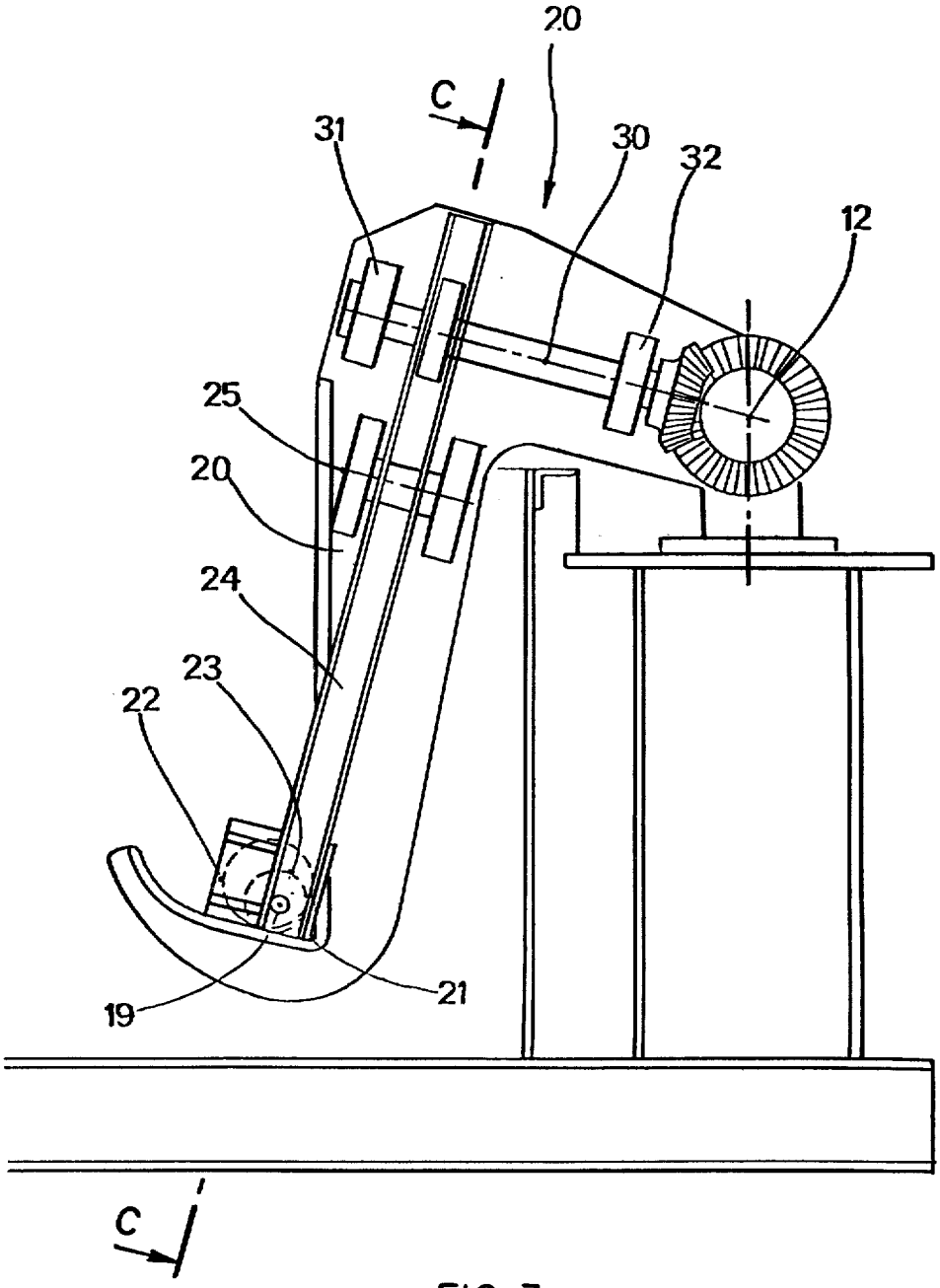
Figure 4:
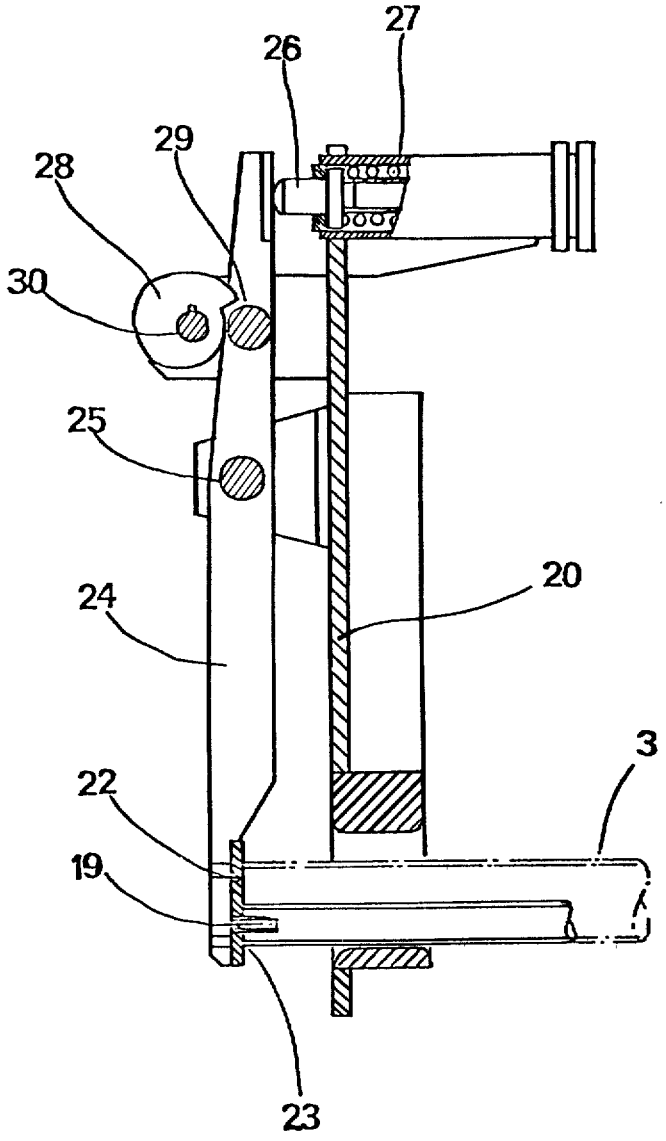
Figure 5A:
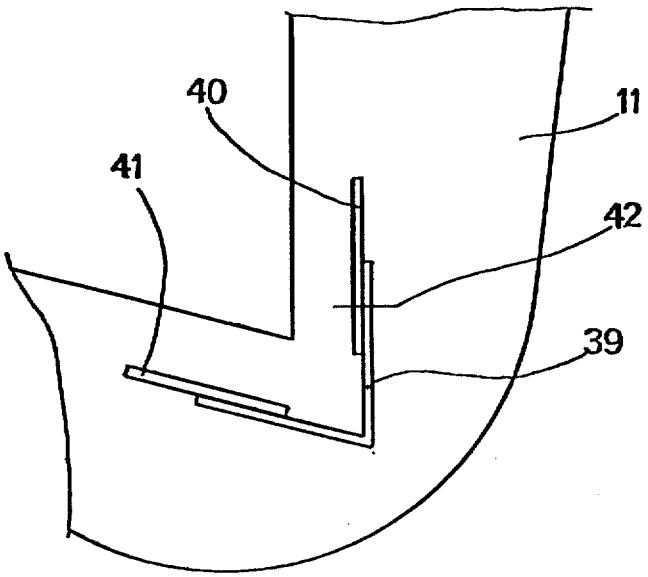
Figure 5B:
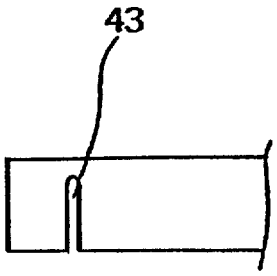
Figure 6A:
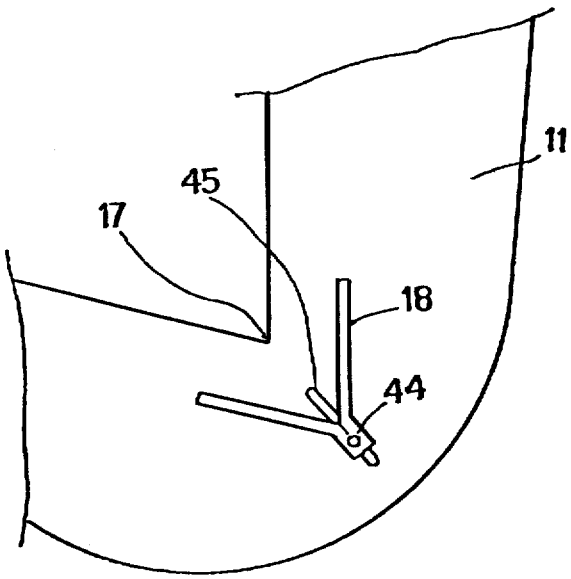
Figure 6B:
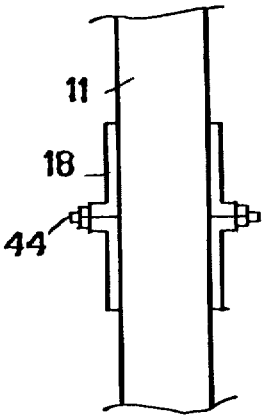
Figure 7:
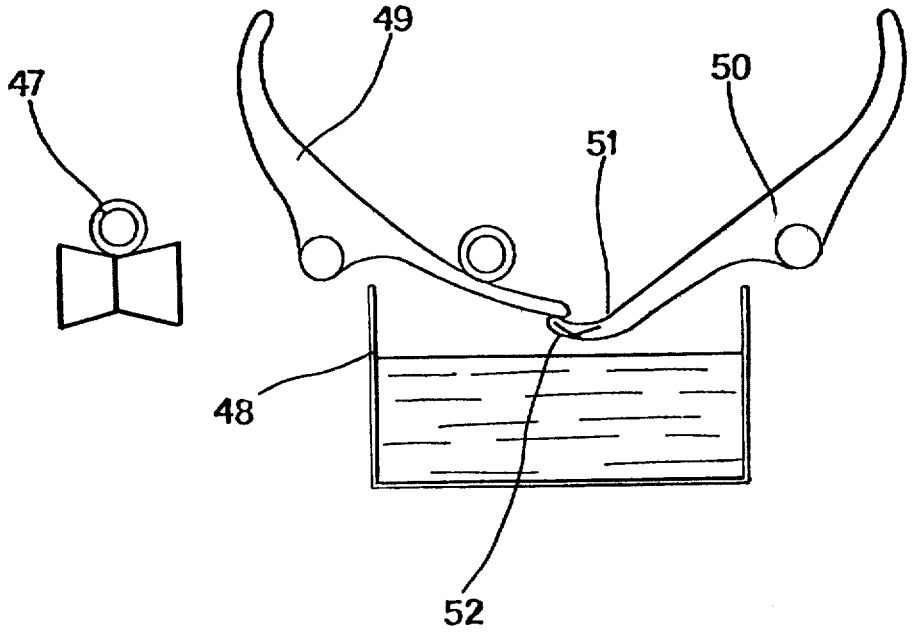

FIG. 3 illustrates in an immersed position, the system for fastening the air nozzle to the end of the tube according to section B—B of Fig. 1, FIG. 4 illustrates the system for fastening the air nozzle to the end of the tube according to section C—C of FIG. 3, FIGS. 5A, 5B, 6A and 6B illustrate different embodiments of deflectors attached to the device for immersing the tubes, and FIG. 7 illustrates in section an alternative embodiment of the quenching device.

A cooling device will initially be described, for which the conveyance of the tubes is ensured by a single device positioned on one side of the quenching tank and for which the lateral transfer device from the conveyor to the immersion system, the immersion device and the device for recovering and laterally transferring the tubes is common.

Figure 2:
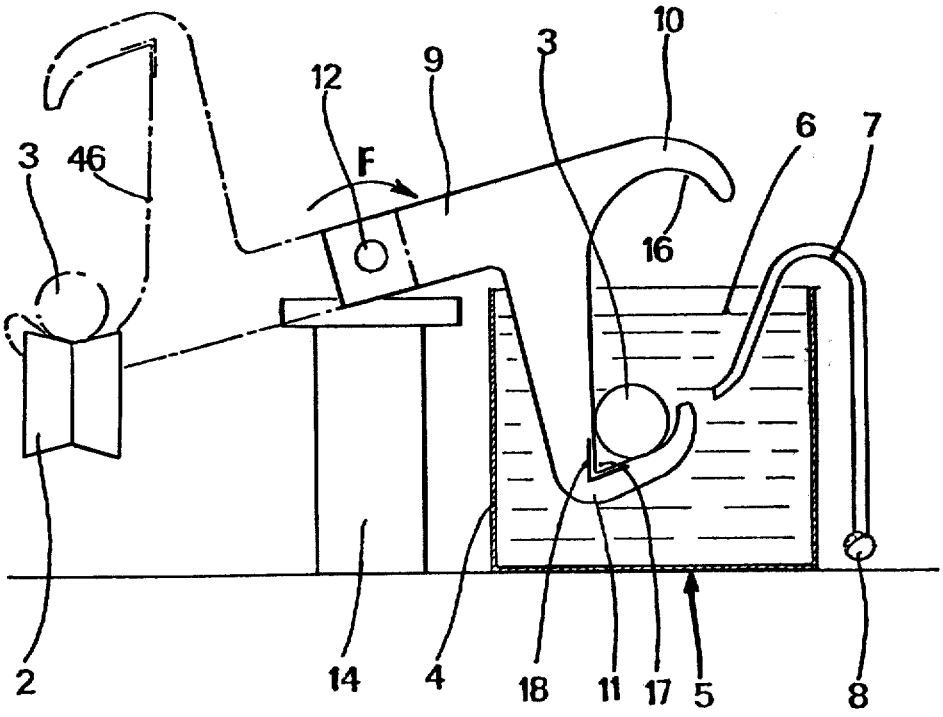
FIG. 2 illustrates a section along a lineal plane A—A of FIG. 1.

In FIGS. 1 and 2, the quenching line comprises a conveyor (1) equipped with rollers (2) on which a tube to be treated (3') moves, in this case, of $\phi$ 100 mm. The tank (4) is constructed parallel to the conveyor (1). It comprises a parallelepipedal block, open at the top, made of sheet metal and positioned on a stand (5). The level of the cooling liquid in the tank is indicated by reference numeral (6). In this case, the tank is filled with water, the temperature of which is maintained in the vicinity of the ambient temperature by a conventional external device which is not shown. A plurality of small lateral tubes (7) for the admission of water is distributed along the complete length of the tank and is fed by a general piping (8). The emptying system of the tank which enables the level to remain constant is not shown.

The lateral transfer device from the conveyor to the immersion system and the immersion system comprises seven arms (9) with two branches (10) and (11) which are regularly distributed over the complete length of the tank. The branches (10) of the arms (9) ensure the removal of the tube (5) from and the depositing of the tube onto the conveyor (1), and the branches (11) form the immersion device. The arms (9) are mounted on a common shaft (12) rotating in a plurality of bearings (13) mounted on beams (14) between the conveyor (1) and the tank (4). They are respectively numbered *9a* to *9g*.

The arms (9) are mounted in alignment on the shaft (12) so that the tube is immersed horizontally. They are simultaneously moved by a jack (15) fixed in two extreme positions corresponding to the conveyor position for the branch (10) and to the immersion position for the branch (11). The branch (10) manipulates the tube with its rounded edge (16). The branch (11) manipulates the tube with its inside angle (17), as illustrated in FIG. 2. An angle iron (18) is attached to the branches (11) in a position located straight below the tube (3) and close to the latter when the tube (3) reaches the level (6) of the liquid. This angle iron (18) extends over the complete length of the tank, from the first arm (*9a*) to the last arm (*9g*).

A device for clamping the tube which is not shown, but is constructed in conventional manner by a jack acting on a mobile arm, the complete device being supported on the indicated arm (*9g*) in FIG. 1, positioned in the immediate vicinity of the system for fastening the air injection nozzle to the end of the tube ensures that the tube (3) is clamped in the inside angle (17) of the arm (*9g*) during immersion.

The device for fastening the air injection nozzle (19) to the tube is illustrated in detail in FIGS. 3 and 4. All of the system is supported by a specific arm (20) mounted on the common shaft (12) and undergoing the same displacements as the arms (9). The arm (20) includes at (21) an internal angle similar to the angles (17) on which the tube (3) comes to rest.

The air injection nozzle (19) is mounted on a plate (22) joining with the end (23) of the tube on the side of the clamping of the tube (3). This plate is supported by an arm (24) pivoting about an axle (25) integral with the arm (20).

The plate (22) is permanently pushed against the end (23) of the tube (3) which has a clean cut and is previously positioned longitudinally by the rod (26) moved by the spring (27), a stop being provided so that the rod does not come out of its bore. However, this movement of the plate towards the tube is compensated by an opposite movement caused by the cam (28) acting on a loose cylindrical roller (29) mounted on the pivoting arm (24). The cam, mounted on the shaft (30) rotating about the two bearings (31 and 32) which are attached to the arms is rotated during the descent of said arm for the immersion of the tube (3) by the system of two conical gears, one of which is stationary and the other is mounted on the camshaft (30). The profile of the cam is such that the plate (22) is supported against the end of the tube (3) in an immersed position, the nozzle (19) then being engaged in the tube (3), as illustrated in FIGS. 3 and 4, and is removed from the end of the tube in an elevated position, before or after immersion, the front end of the air injection nozzle (19) being disengaged from the tube (3) to enable the lateral transfer thereof.

The nozzle (19) is thread-mounted on the plate (22) so that the nozzle diameter may be adapted to the internal diameter of the tube (3) to be treated. The nozzle diameter is generally such that the ratio between the internal cross section of the tube (3) and the cross section of the nozzle (19) is of the order of 3.

Compressed air taken from the standard compressed air system at 5 bars from the workshop is supplied to the nozzle (19) by a flexible pipe which is not shown.

FIGS. 5A, 5B, 6A and 6B illustrate different, unrestricting embodiments of angle irons (18) which are used as deflectors.

FIG. 5A illustrates one embodiment in which the angle iron (18) comprises two parts, the stationary part (39) being attached by soldering to the arm (11), and comprises two adjustable blades (40) and (41). The width of the opening at the end of the angle iron is adjusted by sliding the assembly of thread and bolts (42) in the notch (43) of the blades (40) and (41).

In the embodiment of FIG. 6A, the angle iron (18) has defined dimensions, but it is attached to the arm (9) by an assembly of shank and threaded bolts (44) which come to slide in a vertical slot (45) positioned at inside right angles with the angle (17) in the branch (11) of the arm. The angle irons are attached joining on both sides of the branch (11). The purpose of the adjustment of the angle irons (18) is to render symmetrical the water circulation during the immersion descent of the tubes. Thus, the adjustment of the angle iron must be substantially adapted to the external diameters of the tubes to be treated. This is achieved in this case by the adjustment of the blades or by the relative vertical position of the angle iron. It is also possible to use such angle irons, of which the angular opening of the blades is adjustable.

The cooling device operates in the following manner:

The hot tube (3) is brought from the furnace and is positioned longitudinally on the conveyor (1). By their branch (10), the arms (9) take up the tube (3) in the rounded edges (16), as illustrated in dotted lines in FIG. 2. A first rotation of the arms (9) brings the rectilinear part (46) of the branch (11) into a substantially horizontal position, slightly inclined towards the level (6) and it maintains the arm in this position. The tube is thus transferred from (16) to (17) by rotation without sliding on the rectilinear part (46). The system is designed such that the immersion device formed by the branch (11) and the angle (17) is not immersed when the tube comes from (16) to (17), while the rectilinear part (46) is substantially horizontal. At this level, the front end of the air nozzle (19) is sufficiently withdrawn to allow the free passage of the end of the tube (3). The tube is then clamped by the jack acting on a mobile arm mounted on the arm (9*g*). The arms (9) then continue their rotation indicated by arrow F and air is simultaneously injected into the tube (3). The tube is rapidly immersed by continuation of the rotation of the arms (9). During this rotation, by the clearance of the cam (28) and of the rod (26), the nozzle-supporting plate (22) is plated on the end of the tube (3) having a clean cut edge, thus chiefly allowing air to return into the tube. The tube (3) is maintained immersed for the time required for the cooling thereof at the required temperature. It is then raised by a return rotation of the arms (9). Air is blown into the tube up until the rectilinear part (46) passes to the horizontal which makes it possible to empty the tube (3) of all the water which could have infiltrated inside. The continuation of the return rotation of the arms (9) passes the tube from the angle (17) to the rounded edge (16). The cold tube is then deposited on the conveyor (1) which takes it away to the rest of the production chain. Another hot tube may be introduced for treatment. During the complete operational time of the tank (4), the cooling liquid is stirred vigorously by the small lateral tubes (7) and is maintained at ambient temperature by an external cooling system which is not shown.

The duration of the cycle depends on the tubes to be treated. It is of the order of 30 seconds, without counting the properly so-called immersion time which depends on the gradation of the metal and on the dimensions of the tube.

The installation which has been described has been shown to be particularly valuable for very long tubes (lengths greater than or equal to 15 m), of diameters of from 70 to 150 mm, and having a high ratio of diameter to thickness of about 25. Such tubes emerge from the treatment without any appreciable longitudinal deformation.

The operation cycle of the cooling device is such that it may either be used at the outlet of a heating furnace, or at the outlet of a hot shaping tool, as, for example, a glass extrusion press, in order to subject the metal to quenching or hyperquenching.

FIG. 7 illustrates in section an alternative embodiment of the cooling device in which the hot tubes (47) are brought by a roller conveyor on one side of the cooling tank (48) and are removed cold from the other side of the tank by a conveyor which is not shown. The arm (49) is used for the lateral transfer of the hot tube onto the immersion device.

The immersion device is illustrated by the branch (51) of the arm (50) provided with an angle iron (52), as in the previously described embodiment. Immersion is effected by rotation of the arm (50) and the removal of the cold tube is effected by the opposite rotation of this arm (50).

The device for fastening the air injection nozzle to the end of the tube is the same. It is not illustrated in this Figure.

Another embodiment of the immersion device may allow the tubes to be immersed in an inclined manner, one end coming into contact with the cooling fluid before the other end.

The incline which may be of a few degrees may be obtained by a continuous, relative angular displacement of the arms (9) with respect to each other, or by the thicknesses of the branch in the vertical direction at right angles with the angle (17), being variable and increasing continuously for the different arms (19) distributed along the tank, or by any other adequate means.

Of course, the present invention is not restricted to the embodiments which are described above by way of example and it may be provided with any desirable embodiments, without thereby exceeding the scope or spirit thereof.

We claim:

1. In a device for rapidly cooling hot metal tubes comprising means for transferring hot tubes upstream, a quenching tank, an immersion device means for transferring the hot tubes to the immersion device, means for clamping the tubes, and means for recovering, removing and transferring the cold tubes downstream, the improvement wherein said immersion device comprises a longitudinal deflector positioned straight below the tube to be treated in order to cause a symmetrical circulation of the cooling liquid around the tube during the descent phase into the tank, and an air injection system fastened to one end of the tube to be treated, said injection system being adapted to blow air at a fast flow rate into the tube during the phase that the tube is descending into the tank and is maintained immersed.

2. A device according to claim 1 wherein said cooling tank is equipped with a plurality of cooling liquid injectors distributed longitudinally in the tank.

3. A device according to claim 1 or 2 wherein the same transfer means are used for introducing and removing the tubes.

4. A device according to claims 1 or 2 wherein the deflector extends continuously over all of the cooling tank.

5. A device according to claim 1 or 2 wherein the deflector extends discontinuously over all of the cooling tank to leave a passage for the handling arm.

6. A device according to any one of claims 1, 2, 4 or 5 wherein the deflector is in the form of an angle iron, the blades of the angle iron including sliding plates whereby the extent of the respective blades can be adjusted.

7. A device according to any one of claims 1, 2, 4 or 5 wherein the deflector is adjustable in a vertical position.

8. A device according to any one of claims 1, 2, 4 or 5 wherein the deflector is in the form of a rounded channel.

9. A device according to claim 1 or 2 wherein the air injection device is removable and may be introduced into the tube at the start of the descent phase, then fastened to the corresponding end of the tube during the phase of descent and immersion of the tube.

10. A device according to any one of claims 1, 2 or 9 wherein the device for fastening the nozzle to the end of the tube is supported by a specific arm and is formed by another arm swinging around an axle driven by a pusher rod and a cam controlled by a set of gears.

11. A device according to any one of claims 1 to 10 wherein the tube is immersed in an inclined position into the tank containing the cooling liquid.

12. A device according to any one of claims 1 to 11 wherein the device is mounted at the outlet of a heating furnace.

13. A device according to any one of claims 1 to 11 wherein the device is mounted at the outlet of a hot tube shaping device.

14. A device according to claim 1 wherein the means for laterally transferring the hot tubes onto the immersion device comprise an integral part of the immersion device.

15. A device according to claim 1 wherein the means for recovering the cold tubes comprise an integral part of the immersion device.

16. A device according to claim 7 wherein the deflector is supported on the immersion device, an elongated slot defined by the immersion device, the support means for the deflector including means received in the elongated opening, and wherein the position of said support means within the opening is adjustable whereby the position of the deflector relative to the immersion device is adjustable.

* * * * *